US009018529B2

(12) United States Patent
Sidlyarevich

(10) Patent No.: US 9,018,529 B2
(45) Date of Patent: Apr. 28, 2015

(54) SINGLE MOTOR POWER AND COMMUNICATION CABLE

(71) Applicant: Rockwell Automation Technologies, Inc., Mayfield Heights, OH (US)

(72) Inventor: Timothy P. Sidlyarevich, Rogers, MN (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 301 days.

(21) Appl. No.: 13/647,687

(22) Filed: Oct. 9, 2012

(65) Prior Publication Data

US 2014/0096996 A1 Apr. 10, 2014

(51) Int. Cl.

| | |
|---|---|
| ***H01B 3/30*** | (2006.01) |
| ***H01B 7/04*** | (2006.01) |
| *H01B 7/18* | (2006.01) |
| *H01B 13/02* | (2006.01) |

(52) U.S. Cl.

CPC ..... *H01B 7/04* (2013.01); *H01B 7/1895* (2013.01); *H01B 13/02* (2013.01)

(58) Field of Classification Search

CPC ..... H01B 3/00; H01B 3/441; H01B 7/00; H01B 7/295; H01B 9/00; H01B 11/02

USPC ..... 174/102 R, 103, 105 R, 106 R, 107, 36, 174/110 R, 112, 113 R, 117 R

See application file for complete search history.

(56) References Cited

U.S. PATENT DOCUMENTS

| | | | | |
|---|---|---|---|---|
| 4,156,869 | A | 5/1979 | Schukantz | |
| 4,527,247 | A | 7/1985 | Kaiser et al. | |
| 4,742,475 | A | 5/1988 | Kaiser et al. | |
| 4,916,642 | A | 4/1990 | Kaiser et al. | |
| 4,994,986 | A | 2/1991 | Cihiwsky et al. | |
| 5,444,184 | A | 8/1995 | Hassel | |
| 5,491,299 | A * | 2/1996 | Naylor et al. | 174/36 |
| 5,530,203 | A * | 6/1996 | Adams et al. | 174/36 |
| 5,834,698 | A | 11/1998 | Izui et al. | |
| 5,976,070 | A * | 11/1999 | Ono et al. | 600/110 |
| 6,249,913 | B1 * | 6/2001 | Galipeau et al. | 725/76 |
| 6,362,432 | B1 * | 3/2002 | LaPidus et al. | 174/113 R |
| 6,434,512 | B1 | 8/2002 | Discenzo | |
| 6,448,500 | B1 * | 9/2002 | Hosaka et al. | 174/113 R |
| 6,507,165 | B2 | 1/2003 | Kato et al. | |

(Continued)

OTHER PUBLICATIONS

Heidenhain, "Encoders for Servo Drives," Nov. 2008, 208 922-29-40—Nov. 2008, Printed in Germany (76 pages).

(Continued)

*Primary Examiner* — William H Mayo, III

(74) *Attorney, Agent, or Firm* — Boyle Fredrickson, S.C.

(57) ABSTRACT

A combined power and communications cable for use with a motor and drive unit in an industrial control system is provided. The cable may comprise first, second and third insulated conductors twisted together and covered by a cable jacket (first group); fourth and fifth insulated conductors twisted together and covered by an electrical shield (second group); and a sixth insulated conductor for delivering a protective ground (third group). The first, second and third groups are twisted together, covered by an electrical shield and covered by a cable jacket. Filler may be formed around the fourth and fifth insulated conductors, and may be formed around the first, second and third groups, to substantially maintain round geometric shapes.

20 Claims, 3 Drawing Sheets

(56) References Cited

U.S. PATENT DOCUMENTS

| | | | | |
|---|---|---|---|---|
| 6,757,665 | B1 | 6/2004 | Unsworth et al. | |
| 6,929,396 | B2 | 8/2005 | Gramsamer et al. | |
| 7,208,684 | B2 * | 4/2007 | Fetterolf et al. | 174/113 R |
| 7,304,241 | B2 * | 12/2007 | Trieb et al. | 174/74 R |
| 7,389,278 | B2 | 6/2008 | Unsworth et al. | |
| 7,592,549 | B2 * | 9/2009 | Seufert et al. | 174/113 R |
| 7,595,647 | B2 * | 9/2009 | Kroh et al. | 324/654 |
| 7,740,501 | B2 | 6/2010 | Ballard et al. | |
| 8,525,029 | B2 * | 9/2013 | Kato et al. | 174/113 R |
| 2001/0033146 | A1 | 10/2001 | Kato et al. | |
| 2003/0121694 | A1 * | 7/2003 | Grogl et al. | 174/113 R |
| 2003/0171827 | A1 | 9/2003 | Keyes, IV et al. | |
| 2004/0199480 | A1 | 10/2004 | Unsworth et al. | |
| 2006/0142875 | A1 | 6/2006 | Keyes, IV et al. | |
| 2007/0074891 | A1 * | 4/2007 | Burke | 174/113 R |
| 2007/0289635 | A1 | 12/2007 | Ghazarian et al. | |
| 2009/0062931 | A1 | 3/2009 | Keyes, IV et al. | |
| 2009/0160387 | A1 | 6/2009 | Terorde | |
| 2010/0072931 | A1 | 3/2010 | Bodner et al. | |

OTHER PUBLICATIONS

Helukabel(r), "TOPSERV(r) 110 and TOPSERV(r) 120 Drag chain cable 0,6/1 kV Servo-/Feedback-cables, highly flexible, screened EMC*-preferred," Q19 (1 page).

Leoni Kabel GmbH & Co. KG, Zweigniederlassung Bretzfeld, Claus Schaffroth, Telefax, Feb. 26, 2004 16:26 (1 page).

Tecni Kabel, Specifica Generale di costruzione, No. 17590, Cavo Per Utilizzo in Posa Fissa Approvato UL e CAS, Sep. 6, 2004, Rev.1 Jul. 29, 2004 (3 pages).

Houston Wire & Cable, Vicki Wicihowski, Jan. 23, 2006 14:39 Fax, Belden Wire & Cable Company, Product Code Q979439, Technical Data Sheet, Jan. 20, 2006 Rev. 0 (12 pages).

* cited by examiner

SINGLE MOTOR POWER AND COMMUNICATION CABLE

BACKGROUND OF THE INVENTION

The present invention relates to industrial control systems and, in particular, to power and communications cabling for use with a motor and a drive unit in an industrial control system.

Industrial controllers are specialized computer systems used for the control of industrial processes or machinery, for example, in a factory environment. Industrial controllers typically control numerous modules via specialized control networks for accomplishing different tasks in the industrial system. One such module may be a variable frequency drive ("VFD") unit, which, in turn, may deliver power to, communicate with and control a motor. In industrial applications, motors may be used to affect a variety of motions in the industrial process. For example, motors may be operated at continuous or variable speeds, such as for turning the blades of a fan or the rollers of an assembly line at constant or variable speeds at different times, or may be used to precisely control the position of objects and machines, such as precisely controlling the movement of a robotic arm or the opening and closing of a door.

Drive units typically have access to a power source and utilize a transistor network to deliver high voltage three phase electric power to a motor. Motors typically receive power from the drive unit and in turn feed the power through electrical windings which surround a motor core with one or more magnets, thereby electromagnetically powering the motor. Delivery of such power to the motor typically requires transmission of significant amounts of power and energy, which is inherently a source of electrical interference and noise. As such, drive units typically deliver such power via dedicated power cables to minimize electromagnetic interference ("EMI").

Drive units also typically provide data communication and control over the motor. Such data communication may be bi-directional between the drive unit and the motor. For example, drive units may send communications to the motor to turn the motor on, adjust the position, adjust the direction, adjust the speed, or apply a brake, such as during an emergency. Drive units may also receive communications from the motor, such as for measuring the precise position of the motor, speed (revolutions per minute), temperature, or runtime.

Motors typically include encoders which may precisely measure (or sense) the position of the motor or which may communicate with one or more other intelligent sensors or devices integrated with the motor, such as a temperature sensor or timer. The encoders may communicate such information to the drive unit. Encoders may communicate information via one or more digital data signals over a transmission line, which may be for example a single-ended line or a differential pair.

All such communication transmission lines typically involve low voltage electrical signals that are susceptible to electrical interference and noise, which may thereby cause signal integrity loss and resulting data loss. Consequently, drive units typically communicate with motors via dedicated communications cables.

Current implementations requiring multiple cables for separate power delivery and communications thereby increasing the cost and complexity of the designs by automatically doubling the number of cables and connectors that are required. On the other hand, recent attempts toward combining power and communication conductors in a single cable continue to suffer from electrical noise and interference drawbacks on the data communication lines as described above, thereby limiting their possible range of transmission line lengths, data communication speeds and system reliability.

SUMMARY OF THE INVENTION

The present inventors have recognized that power delivery and communications for use with a motor and a drive unit in an industrial control system may be combined in single cable to reduce the cost and complexity of designs, while also minimizing the drawbacks of other such attempts. The present inventors have recognized that by grouping, electrically shielding and jacketing particular conductors, and by strategically applying certain fillers, noise and interference onto the low voltage communication conductors caused by the high voltage power conductors is minimized.

As described herein, grouping power delivery conductors together into a power triad minimizes their inductive coupling effects onto grouped, neighboring communications conductors. Also, grouping and electrically shielding communications conductors minimizes capacitive coupling effects and resulting signal integrity loss. Also particular utilization of insulating material having a low dielectric constant and filler material for substantially maintaining round geometric shapes further minimizes cable capacitance and power signal reflections, thereby improving signal integrity and system durability. Such constructions effectively ensure lower transfer impedance between the power conductors and the communications conductors, thereby allowing high voltage power to be simultaneously delivered with low voltage data communication over the same cable while minimizing the drawbacks of the prior art.

Aspects of the present invention provide in one embodiment a combined power and communications cable for use with a motor and a drive unit in an industrial control system comprising: first, second and third insulated conductors for delivering three phase electric power, the first, second and third insulated conductors twisted together around a common center and covered by a cable jacket forming a first group; fourth and fifth insulated conductors for data communication, the fourth and fifth insulated conductors twisted together around a common center and covered by an electrical shield forming a second group; and a sixth insulated conductor for delivering a protective ground, forming a third group. The first, second and third groups are twisted together, covered by an electrical shield, which may be braided copper shield, and covered by an extruded jacket. Each conductor in the second group may have a greater wire gauge than any conductor in the first group, and the second group may be covered by a cable jacket. An internal binder may be applied over the second group.

The combined power and communications cable may further comprise seventh and eighth insulated conductors for providing control over the motor. The seventh and eighth insulated conductors twisted together around a common center and are covered by an electrical shield forming a fourth group, wherein the first, second, third and fourth groups are twisted together, covered by an electrical shield and covered by an extruded cable, jacket. Each conductor in the fourth group may have a greater wire gauge than any conductor in the first group. The seventh and eighth insulated conductors may provide motor brake control.

The combined power and communications cable may further comprise filler formed around the fourth and fifth insulated conductors twisted together, the filler beneath the electrical shield of the second group, thereby substantially maintaining a round geometric shape. Filler may also be formed around the first, second and third groups twisted together, the filler beneath the electrical shield and the cable jacket, thereby substantially maintaining a round geometric shape. The filler may be polypropylene.

Aluminized metallic tape may also be applied around the first, second and third groups twisted together, the aluminized metallic tape beneath the electrical shield and the cable jacket, and each conductor may be comprised of stranded copper.

Another embodiment may provide a method for combining power and communications in a cable for use with a motor and a drive unit in an industrial control system comprising: twisting together first, second and third insulated conductors for delivering three phase electric power around a common center and covering the first, second and third insulated conductors in a cable jacket forming a first group; twisting together fourth and fifth insulated conductors for data communication around a common center and covering the fourth and fifth insulated conductors in an electrical shield forming a second group; providing a sixth insulated conductor for delivering a protective ground, forming a third group; and twisting together the first, second and third groups and covering the first, second and third groups in an electrical shield and in a cable jacket.

The method may further comprise twisting together seventh and eighth insulated conductors for providing control over the motor around a common center and covering the seventh and eighth insulated conductors in an electrical shield forming a fourth group; wherein the step of twisting together the first, second and third groups and covering the first, second and third groups in an electrical shield and in a cable jacket includes twisting together with the fourth group and covering with the fourth group in an electrical shield and in a cable jacket.

The method may further comprise forming filler around the fourth and fifth insulated conductors twisted together before covering the fourth and fifth insulated conductors in an electrical shield, and forming filler around the first, second and third groups twisted together before covering the first, second and third groups in an electrical shield and in a cable jacket. In addition, the method may further comprise covering aluminized metallic tape around the first, second and third groups twisted together before covering the first, second and third groups in an electrical shield and in a cable jacket.

Yet another embodiment may provide an industrial control system comprising: a motor powered by three phase electric power and having an encoder; a drive unit for delivering three phase electric power to the motor and for communicating with the encoder; and a combined power and communications cable coupling the motor and the drive unit, the combined power and communications cable. The combined power and communications cable may comprise: first, second and third insulated conductors for delivering the three phase electric power to the motor, the first, second and third insulated conductors twisted together around a common center and covered by a cable jacket forming a first group; fourth and fifth insulated conductors for communicating with the encoder, the fourth and fifth insulated conductors twisted together around a common center and covered by an electrical shield forming a second group; and a sixth insulated conductor for delivering a protective ground, forming a third group. The first, second and third groups are twisted together, covered by an electrical shield and covered by an extruded cable jacket.

Filler may be formed around the fourth and fifth insulated conductors twisted together, the filler beneath the electrical shield of the second group, thereby substantially maintaining a round geometric shape, and filler may be formed around the first, second and third groups twisted together, the filler beneath the electrical shield and the cable jacket, thereby substantially maintaining a round geometric shape.

These and other objects, advantages and aspects of the invention will become apparent from the following description. The particular objects and advantages described herein may apply to only some embodiments falling within the claims and thus do not, define the scope of the invention. In the description, reference is made to the accompanying drawings which form a part hereof, and in which there is shown a preferred embodiment of the invention. Such embodiment does not necessarily represent the full scope of the invention and reference is made, therefore, to the claims herein for interpreting the scope of the invention.

DETAILED DESCRIPTION OF THE PREFERRED EMBODIMENT

One or more specific embodiments of the present invention will be described below. It is specifically intended that the present invention not be limited to the embodiments and illustrations contained herein, but include modified forms of those embodiments including portions of the embodiments and combinations of elements of different embodiments as come within the scope of the following claims. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the present invention unless explicitly indicated as being "critical" or "essential."

Figure 1:
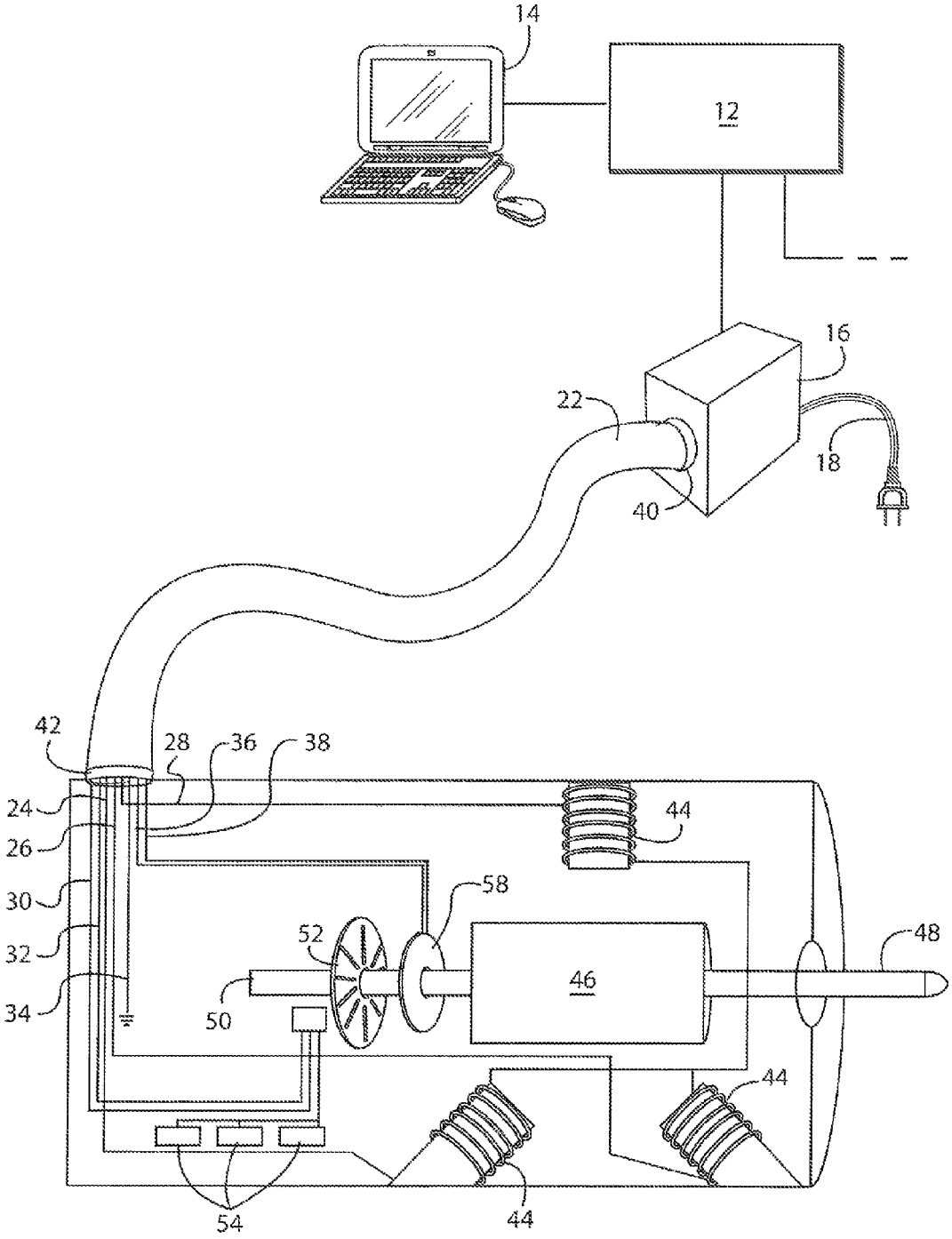
FIG. 1 is a diagram of an industrial control system with a combined power and communications cable for use with a motor and a drive unit in accordance with an embodiment of the present invention.

Referring now to the drawings wherein like reference numbers correspond to similar components throughout the several views and, specifically, referring to FIG. 1, the present invention shall be described in the context of an industrial control network 10. The industrial control network 10 may include a programmable logic controller ("PLC") 12 with a locally accessible computer terminal 14 having a keyboard, mouse and a display. The PLC 12 may communicate via a control network with a VFD drive unit 16. The drive unit 16 has access to a power source and utilizes a transistor network (not shown) to deliver three phase electric power to a motor 20 via a combined power and communications cable 22. The drive unit 16 also bi-directionally communicates data with the motor 20 via cable 22.

The cable 22 includes first, second and third insulated conductors 24, 26 and 28, respectively, for delivering the three phase electric power to the motor 20. The cable 22 also includes fourth and fifth insulated conductors 30 and 32, respectively, for data communication with the motor 20. The cable 22 also includes a sixth insulated conductor 34 for delivering a protective ground to the motor 20. The cable 22 may also optionally include seventh and eighth insulated conductors 36 and 38, respectively, for additional control over the motor 20. The cable 22 connects to the drive unit 16 at a single drive unit connector 40, and connects to the motor 20 at a single motor connector 42, thereby electrically and mechanically coupling the drive unit 16 to the motor 20.

The motor 20 comprises a stator with electrical windings 44 which are placed around a rotor 46 with magnets. The motor 20, receiving the power from the drive unit 16, feeds the power into the electrical windings 44, which, in turn, electromagnetically interact with the rotor 46 with magnets, creating a mechanical force to thereby rotate the motor. As a result, the rotor 46 rotates the shaft 48 accordingly, which may affect a variety of motions in the industrial process (not shown). Depending on how power is applied to the electrical windings 44, the shaft 48 may be moved and stopped only at precise positions, in either rotary direction (or may be moved at continuous or varying speeds).

The motor 20 may also comprise an encoder 50 which may precisely measure (or sense) the position of the shaft 48 via a detection plate 52, or which may communicate with one or more other intelligent sensors or devices 54 integrated within the motor, such as a temperature sensor or a timer. The encoder 50 may then communicate such information to the drive unit 16 via the fourth and fifth insulated conductors 30 and 32. The encoder 50 may also receive communications from the drive unit 16 via the fourth and fifth insulated conductors 30 and 32 to effect such operations as the motor may be configured to allow. In an alternative embodiment, the encoder may comprise further logic acting on the electrical power delivery to the motor, thereby exercising control over such aspects as precisely moving the motor in either direction.

The motor 20 may also optionally comprise a solenoid actuated brake 58, which is attached to shaft 48 and is designed to lock in place when controlled to do so, allowing for motor service and braking. The solenoid actuated brake 58 may receive a low voltage communication from the drive unit 16 via the seventh and eighth insulated conductors 36 and 38 to apply a brake to stop the motor, such as during an emergency.

Figure 2:
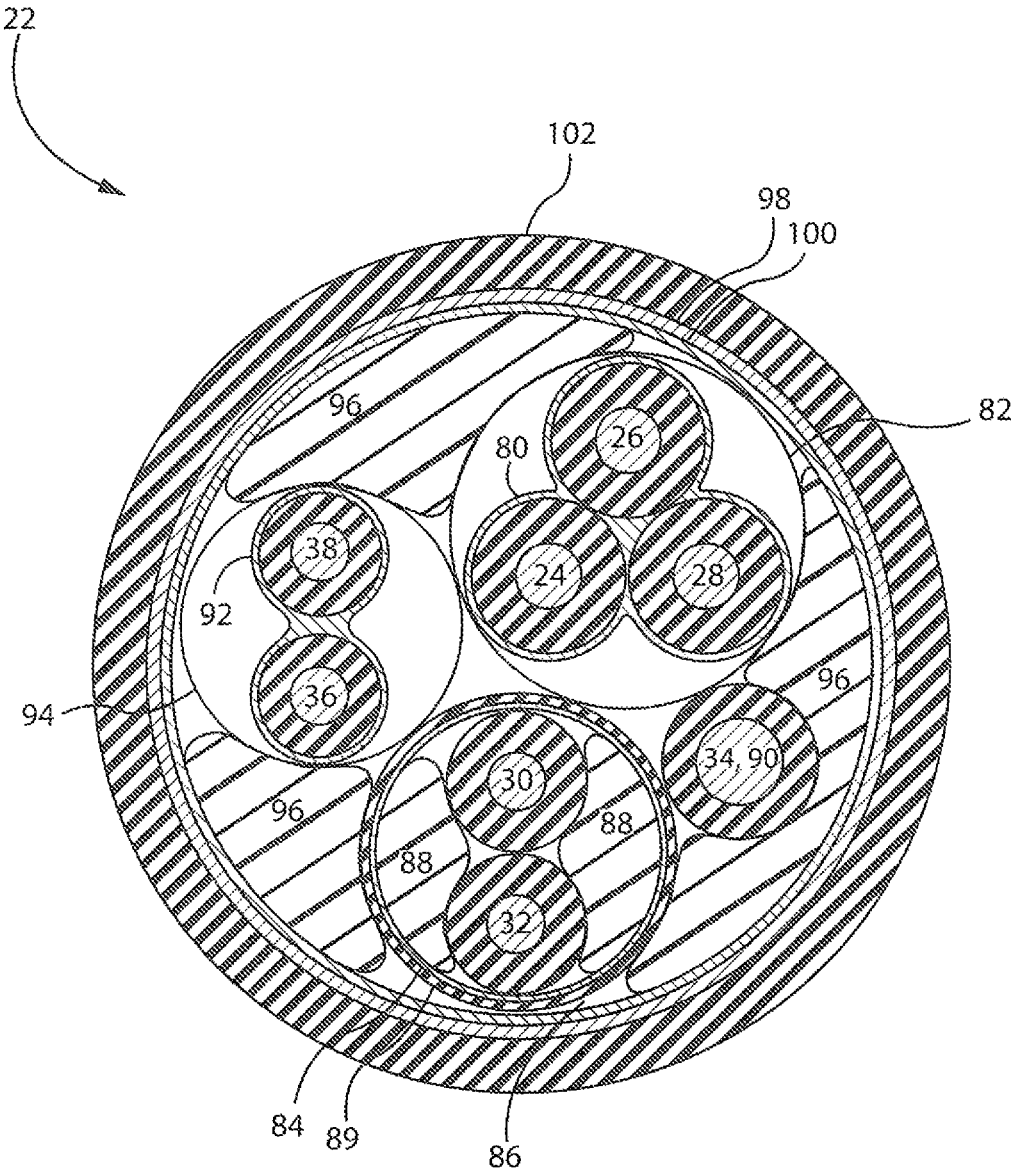
FIG. 2 is a cross-sectional view of the combined power and communications cable of FIG. 1 in accordance with an embodiment of the present invention.

Referring now to FIG. 2, a cross-sectional view of the cable 22 is shown in accordance with an embodiment of the present invention. First, second and third insulated conductors 24, 26 and 28, respectively, for delivering three phase electric power and having high voltage relative to the communications signals, are twisted together around a common center and covered by a cable jacket 80, forming a first group 82 comprising a power triad. This construction ensures minimum inductive cross coupling between power conductors and communications conductors, both of which are enclosed under the same electrical shield as further described, by positioning the power triad (first group) such that the inherent electric fields work against each other and provide effective cancellation of undesirable energy.

Capacitance between conductors within the power triad (first group) may be further minimized by using insulators with a very low dielectric constant. Such capacitance optimizations ensure lower reflected waves and cross coupling caused by the power triad (first group) and the communications conductors/transmission lines.

The high voltage first, second and third insulated conductors 24, 26 and 28 may be sized in accordance with the motor load and may have insulation colors, for example, of blue, black and brown. Each of the first, second and third insulated conductors 24, 26 and 28 may also comprise stranded copper wires, and may typically have an American Wire Gauge (AWG) rating of about 18 (e.g., 7 strands×26 gauge; 16 strands×30 gauge; 19 strands×30 gauge; 41 strands×34 gauge; or 65 strands×36 gauge). The twist rate of the first, second and third insulated conductors 24, 26 and 28 together may depend on the selected wire gauge sizes, the desired flex rating and process demands.

Covering the first, second and third insulated conductors 24, 26 and 28 in the cable jacket 80 ensures consistency in the conductor-conductor distance, the conductor-conductor capacitance and in final cabling operation.

The low voltage fourth and fifth insulated conductors 30 and 32 for data communication are separately twisted together around a common center and covered by an electrical shield 84, forming a second group 86. Conductor-conductor impedance and other transmission line parameters may be tightly controlled to ensure optimal signal integrity. The fourth and fifth insulated conductors 30 and 32 may utilize insulation with a low dielectric constant. The electrical shield 84 may be constructed by covering the fourth and fifth insulated conductors 30 and 32 with aluminized tape and applying a braided copper shield over the tape. A high fill factor it the second group 86 helps to achieve lower shield transfer impedance.

The fourth and fifth insulated conductors 30 and 32 may be sized in accordance with regulatory demands and may have insulation colors, for example, of blue and white/blue. Each of the fourth and fifth insulated conductors 30 and 32 may comprise stranded copper wires and may typically have an AWG rating of about 22 (e.g., 7 strands×30 gauge; 19 strands×34 gauge; or 26 strands×36 gauge). The twist rate of the fourth and fifth insulated conductors 30 and 32 together may depend on the selected wire gauge sizes, the desired flex rating and process demands.

Filler 88, such as polypropylene, may be applied for substantially maintaining the round geometric shape of the twisted fourth and fifth insulated conductors 30 and 32, thereby further minimizing noise and interference onto the communication signals by ensuring improved impedance matching to electronics in the encoder and in the drive unit. The filler 88 around the fourth and fifth insulated conductors 30 and 32 twisted together is beneath the electrical shield 84 forming the second group 86. The filler essentially fills the valleys that result from twisting, together the fourth and fifth insulated conductors 30 and 32. The density of the filler is controlled to ensure overall roundness of the twisted, shielded insulated conductors, which results in improved transmission line characteristics. An optional tube binder or extruded jacket 89 may be applied over the electrical shield 88.

The sixth insulated conductor 34 for delivering a protective ground forms a third group 90. The sixth insulated conductor 34 may be sized in accordance with the motor load and may have an insulation color, for example, of green with a yellow stripe. The sixth insulated conductor 34 essentially provides a safety ground for motor installations and a conductive path for common mode currents to return to the drive unit 16. The insulator for the sixth insulated conductor 34 may be constructed with a low dielectric to provide low phase-ground capacitance.

The optional low voltage seventh and eighth insulated conductors 36 and 38 for brake control are separately twisted together around a common center and covered by an electrical shield 92 forming an optional fourth group 94. Again, the twist rate may depend on the selected wire gauge sizes, the desired flex rating and process demands. The seventh and eighth insulated conductors 36 and 38 do not require precise impedance control as they are not intended to be utilized as communication conductors, but rather control, such as for the motor brake control. Insulation selection and wall thickness may be determined by mechanical factors and regulatory demands.

The electrical shield 92 may consist of a braided shield installed to provide a secondary safety barrier between the high voltage power triad first group 82 and the low voltage optional fourth group 94. Conductor extruded insulation provides primary protection, while a conductive electrical shield provides a secondary level of protection, and a medium shield fill factor may be provided.

The first, second and third groups 82, 86 and 90, respectively, and the optional fourth group 94, if present, are twisted together. Again, the twist rate may depend on the selected wire gauge sizes, the desired flex rating and process demands. Similar to that described above, a filler 96, such as polypropylene, may be applied for substantially maintaining the round geometric shape of the twisted first, second, third and optional fourth groups 82, 86, 90 and 94, respectively, thereby further minimizing noise and interference onto the communication signals.

The twisted together first, second, third and optional fourth groups 82, 86, 90 and 94 are covered by a braided copper electrical shield 98. The electrical shield 98 may be a braided copper shield used to minimize cable EMI. A high fill factor may be used to ensure low transfer impedance (i.e., high shielding effectiveness) for improved noise rejection.

The filler 96 around the first, second, third and optional fourth groups 82, 86, 90 and 94 twisted together is beneath the electrical shield 98. The filler essentially fills the valleys that result from twisting together the first, second, third and optional fourth groups 82, 86, 90 and 94. The density of the filler is controlled to ensure overall roundness of the twisted groups, which results in improved transmission line characteristics.

An optional aluminized metallic tape 100 may be wrapped over the cable core and under the electrical shield 98 in a non-flex cable variant to attenuate high frequency electrical noise. The aluminized metallic tape 100 may be applied in a manner so as to provide sufficient overlap resulting in complete coverage.

Finally, the electrical shield 98, and optional aluminized metallic tape 100, may be covered by an extruded cable jacket 102, extruded over cable core having the electrical shield 98, and optional aluminized metallic tape 100. At extruded cable jacket material and thickness may be determined by regulatory demands. The cable jacket 102 may provide physical protection from the elements and improved durability.

Figure 3:
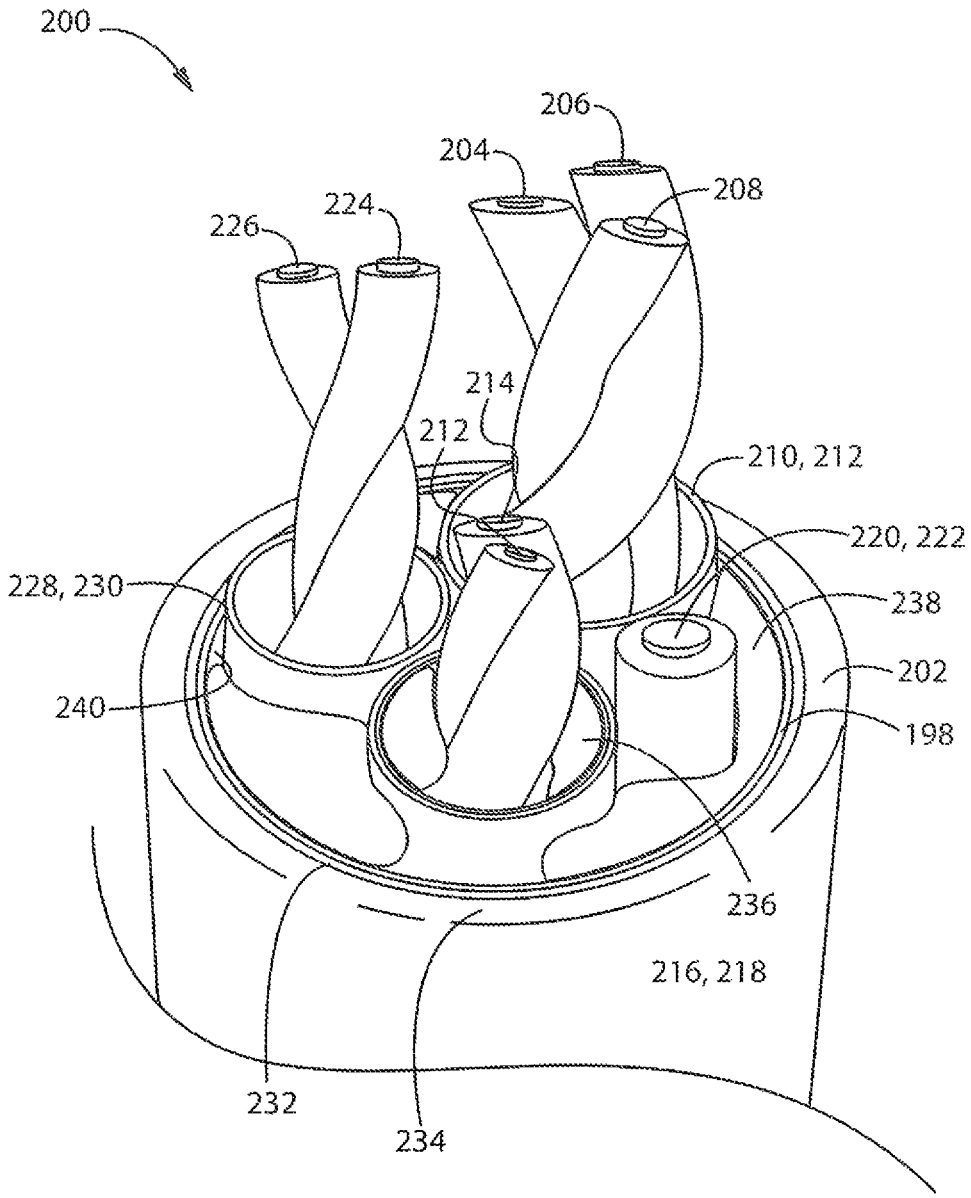
FIG. 3 is an isometric view of another embodiment of the combined power and communications cable.

Referring now to FIG. 3, an isometric view of another embodiment of the combined power and communications cable 200 is shown. Power and communications in the cable 200 may be combined by twisting first, second and third insulated conductors 204, 206 and 208 for delivering three phase electric power around a common center and covering the first, second and third insulated conductors 204, 206 and 208 in a cable jacket 210 forming a first group 212; twisting together fourth and fifth insulated conductors 212 and 214 for data communication around a common center and covering the fourth and fifth insulated conductors 212 and 214 in an electrical shield 216, forming a second group 218; and providing a sixth insulated conductor 220 for delivering a protective ground, forming a third group 222. An alternative embodiment may further provide twisting together seventh and eighth insulated conductors 224 and 226 for control around a common center and covering the seventh and eighth insulated conductors 224 and 226 in an electrical shield 228 forming an optional fourth group 230. Finally, the power and communications in the cable 200 is combined by twisting together the first, second, third and optional fourth groups 212, 218, 222 and 230, respectively, and covering the first, second, third and optional fourth groups 212, 218, 222 and 230 in an electrical shield 232 and in an extruded cable jacket 234.

The power and communications in the cable 200 may also comprise forming filler 236 around the fourth and fifth insulated conductors 212 and 214 twisted together and beneath the electrical shield 216 forming the second group 218 for substantially maintaining a round geometric shape. In addition, the power and communications in the cable 200 may also comprise forming filler 238 around the first, second, third and optional fourth groups 212, 218, 222 and 230 twisted together and beneath the electrical shield 232 for substantially maintaining a round geometric shape.

The power and communications in the cable 200 may also comprise covering aluminized metallic tape 240 around the first, second, third and optional fourth groups 212, 218, 222 and 230 twisted together before covering the first, second, third and optional fourth groups 212, 218, 222 and 230 in the electrical shield 232 and in the cable jacket 234.

Certain terminology is used herein for purposes of reference only, and thus is not intended to be limiting. For example, terms such as "upper," "lower," "above," and "below" refer to directions in the drawings to which reference is made. Terms such as "front," "back," "rear," "bottom," "side," "left" and "right" describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second" and other such numerical terms referring to structures do not imply a sequence or order unless clearly indicated by the context.

When introducing elements or features of the present disclosure and the exemplary embodiments, the articles "a," "an," "the" and "said" are intended to mean that there are one or more of such elements or features. The terms "comprising," "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as coming within the scope of the following claims. All of the publications described herein including patents and non-patent publications are hereby incorporated herein by reference in their entireties.

What is claimed is:

1. A combined power and communications cable for use with a motor and a drive unit in an industrial control system comprising:

first, second and third insulated conductors for delivering three phase electric power, the first, second and third insulated conductors twisted together around a common center and covered by a cable jacket forming a first group;

fourth and fifth insulated conductors for data communication, the fourth and fifth insulated conductors twisted together around a common center and covered by an electrical shield forming a second group; and a sixth insulated conductor for delivering a protective ground, forming a third group;

wherein the first, second and third groups are twisted together, covered by an electrical shield and covered by a cable jacket.

2. The combined power and communications cable of claim 1, wherein each conductor in the second group has a greater wire gauge than any conductor in the first group.

3. The combined power and communications cable of claim 1, further comprising seventh and eighth insulated conductors for providing control over the motor, the seventh and eighth insulated conductors twisted together around a common center and covered by an electrical shield forming a fourth group, wherein the first, second, third and fourth groups are twisted together, covered by an electrical shield and covered by a cable jacket.

4. The combined power and communications cable of claim 3, wherein each conductor in the fourth group has a greater wire gauge than any conductor in the first group.

5. The combined power and communications cable of claim 3, wherein the seventh and eighth insulated conductors provide motor brake control.

6. The combined power and communications cable of claim 1, further comprising filler formed around the fourth and fifth insulated, conductors twisted together, the filler beneath the electrical shield of the second group, thereby substantially maintaining a round geometric shape.

7. The combined power and communications cable of claim 6, wherein the filler is polypropylene.

8. The combined power and communications cable of claim 1, wherein the second group is covered by a cable jacket.

9. The combined power and communications cable of claim 1, further comprising filler formed around the first, second and third groups twisted together, the filler beneath the electrical shield and the cable jacket, thereby substantially maintaining a round geometric shape.

10. The combined power and communications cable of claim 9, herein the filler is polypropylene.

11. The combined power and communications cable of claim 1, further comprising aluminized metallic tape around the first, second and third groups twisted together, the aluminized metallic tape beneath the electrical shield and the cable jacket.

12. The combined power and communications cable of claim 1, wherein each conductor is comprised of stranded copper.

13. A method for combining power and communications in a cable for use with a motor and a drive unit in an industrial control system comprising:

twisting together first, second and third insulated conductors for delivering three phase electric power around a common center and covering the first, second and third insulated conductors in a cable jacket forming a first group;

twisting together fourth and fifth insulated conductors for data communication around a common center and covering the fourth and fifth insulated conductors in an electrical shield forming a second group;

providing a sixth insulated conductor for delivering a protective ground, forming a third group; and twisting together the first, second and third groups and covering the first, second and third groups in an electrical shield and in a cable jacket.

14. The method of claim 13, further comprising:

twisting together seventh and eighth insulated conductors for providing control over the motor around a common center and wrapped the seventh and eighth insulated conductors in an electrical shield forming a fourth group; wherein the step of twisting together the first, second and third groups and covering the first, second and third groups in an electrical shield and in a cable jacket includes twisting together with the fourth group and covering with the fourth group in an electrical shield and in a cable jacket.

15. The method of claim 13, further comprising forming filler around the fourth and fifth insulated conductors twisted together before covering the fourth and fifth insulated conductors in an electrical shield.

16. The method of claim 13, further comprising forming filler around the first, second and third groups twisted together before covering the first, second and third groups in an electrical shield and in a cable jacket.

17. The method of claim 13, further comprising covering aluminized metallic tape around the first, second and third groups twisted together before covering the first, second and third groups in an electrical shield and in a cable jacket.

18. An industrial control system comprising:

a motor powered by three phase electric power and having an encoder;

a drive unit for delivering three phase electric power to the motor and for communicating with the encoder;

a combined power and communications cable coupling the motor and the drive unit, the combined power and communications cable comprising:

first, second and third insulated conductors for delivering the three phase electric power to the motor, the first, second and third insulated conductors twisted together around a common center and covered by a cable jacket forming a first group;

fourth and fifth insulated conductors for communicating between with the encoder, the fourth and fifth insulated conductors twisted together around a common center and covered by an electrical shield forming a second group; and a sixth insulated conductor for delivering a protective ground, forming a third group;

wherein the first, second and third groups are twisted together, covered by an electrical shield and covered by a cable jacket.

19. The industrial control system of claim 18, further comprising filler formed around the fourth and fifth insulated conductors twisted together, the filler beneath the electrical shield of the second group, thereby substantially maintaining a round geometric shape.

20. The industrial control system of claim 18, further comprising filler formed around the first, second and third groups twisted together, the filler beneath the electrical shield and the cable jacket, thereby substantially maintaining a round geometric shape.

* * * * *